United States Patent [19]

Che et al.

[11] Patent Number: 4,623,444

[45] Date of Patent: Nov. 18, 1986

[54] UPGRADING SHALE OIL BY A COMBINATION PROCESS

[75] Inventors: Stanley C. Che, Los Alamitos, Calif.; Ajay Madgavkar, Katy, Tex.

[73] Assignee: Occidental Oil Shale, Inc., Grand Junction, Colo.

[21] Appl. No.: 749,482

[22] Filed: Jun. 27, 1985

[51] Int. Cl.[4] ..... C10G 7/00; C10G 21/16

[52] U.S. Cl. ..... 208/92; 208/96; 208/254 R; 208/254 H; 208/282

[58] Field of Search ..... 208/254 R, 254 H, 87, 208/92, 96, 265, 282, 95

[56] References Cited

U.S. PATENT DOCUMENTS

| | | | |
|---|---|---|---|
| 2,263,176 | 11/1941 | Lazar et al. | 208/282 |
| 2,848,375 | 8/1958 | Gatsis | 208/265 |
| 3,052,620 | 9/1962 | Hanson | 208/254 R |
| 3,256,175 | 6/1966 | Kozlowski et al. | 208/87 |
| 3,514,395 | 5/1970 | McVay et al. | 208/96 |
| 3,649,528 | 3/1972 | Kartzmark et al. | 208/254 R |
| 4,209,385 | 6/1980 | Stover | 208/254 R |
| 4,272,361 | 6/1981 | Compton | 208/282 |
| 4,424,121 | 1/1984 | Choi et al. | 208/254 R |
| 4,426,280 | 1/1984 | Chen et al. | 208/254 R |

*Primary Examiner*—Andrew H. Metz
*Assistant Examiner*—Anthony McFarlane
*Attorney, Agent, or Firm*—Christie, Parker & Hale

[57] ABSTRACT

A method for reducing the nitrogen content of shale oil is disclosed. The method comprises distilling shale oil to form a distillate containing lighter shale oil compounds and a residue containing heavier compounds. Nitrogen-containing compounds are extracted from the distillate to form a first nitrogen-lean raffinate and a first nitrogen-rich extract. Nitrogen-containing compounds are also extracted from the residue to form a second nitrogen-lean raffinate and a second nitrogen-rich extract. The second nitrogen-lean raffinate is hydro-treated to further reduce its nitrogen content.

43 Claims, 1 Drawing Figure

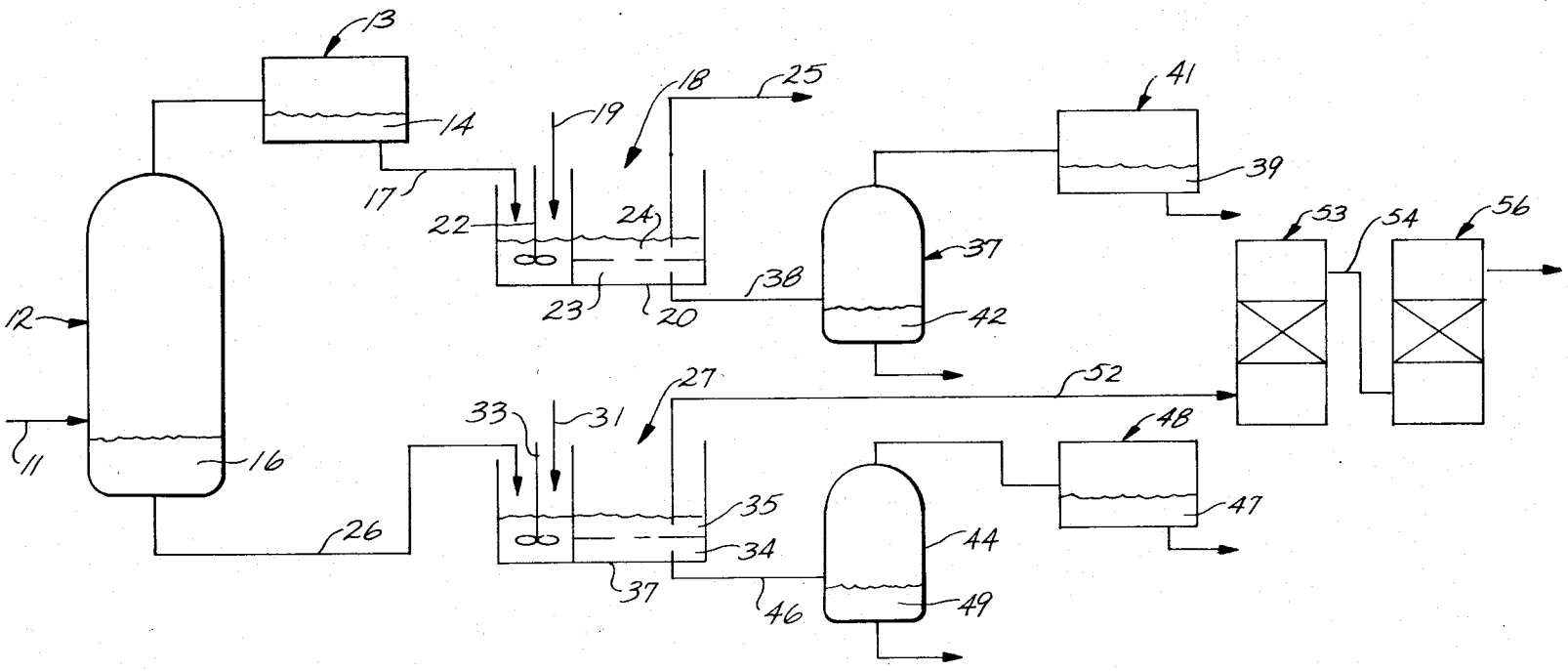
56
54
53
39
41
47
48
52
37
42
44
49
25
38
46
35
34
18
20
27
24
37
19
23
31
22
33
14
17
26
13
16
12
11

UPGRADING SHALE OIL BY A COMBINATION PROCESS

FIELD OF THE INVENTION

The process herein relates to upgrading shale oil by first distilling the shale oil to produce a distillate containing lighter nitrogen-containing compounds and a bottoms containing heavier nitrogen-containing compounds and then separately contacting the shale oil distillate and the shale oil bottoms with chemical extracting agents for selectively extracting nitrogen-containing compounds from shale oil.

BACKGROUND OF THE INVENTION

The term "oil shale" as used in the industry refers to a sedimentary formation comprising marlstone deposits with layers containing an organic polymer called "kerogen" which, upon heating, decomposes to produce liquid and gaseous products. The formation containing kerogen is called "oil shale" herein and the liquid product produced upon decomposition or kerogen is called "shale oil".

In a preferred practice of the method described herein, the method is utilized for refining shale oil produced from in situ retorting of oil shale. An in situ shale retort can be formed by many methods, such as the methods disclosed in U.S. Pat. Nos. 3,661,423, 4,043,595, 4,043,596, 4,043,597, and 4,043,598, all of which are incorporated herein by this reference.

The process can also be practiced on shale oil produced by other methods of retorting. Many of these methods for shale oil production are described in *Synthetic Fuels Data Handbook,* compiled by Dr. Thomas A, Henrickson, and published by Cameron Engineers, Inc., Denver, Colo. For example, other processes for retorting oil shale include those known as the TOSCO, Paraho Direct, Paraho Indirect, N-T-U, and Bureau of Mines, Rock Springs, processes.

Kerogen is considered to have been formed by the deposition of plant and animal remains in marine and nonmarine environments. Its formation is unique in nature. Alteration of this deposited material during subsequent geological periods produced a wide variety of organic materials. Source material and conditions of deposition were major factors influencing the type of final product formed.

Kerogen samples, found in various parts of the world, have nearly the same elemental composition. However, kerogen can consist of many different compounds having differing chemical structures. Some compounds found in kerogen have the structures of proteins while some have structures of terpenoids, and others have structures of asphalts and bitumens.

Shale oils are generally high molecular weight, viscous organic liquids, of predominantly hydrocarbonaceous oxygen, nitrogen and sulfur-containing organic compounds produced from oil shale. The shale oils are of varying linear, branched cyclic, aromatic hydrocarbon and substituted hydrocarbon content with high pour points, moderate sulfur content, large amounts of metallic impurities, especially arsenic, and relatively high nitrogen content.

The shale oil produced from an oil shale formation can vary between strata within the oil shale formation. The nitrogen content of shale oil can also vary dependent upon the geographical location of the oil shale deposit from which the shale oil is produced. Such a variance in nitrogen content in different geographical locations can be attributed to differences in the environment during the time of the deposition of the organisms which, upon lithification, become oil shale. Such a variance can also be attributed to the different types of organisms in the separate geographical locations which are deposited to form the organic substance in the oil shale and any organisms within the formed deposit layer which acted upon such deposited material to provide the kerogen within the oil shale formation. Furthermore, the nitrogen content of shale oil may vary according to the process and operating variables used to produce it.

The nitrogen content in shale oil is attributable to basic nitrogen-containing compounds and non-basic nitrogen-containing compounds. The relative percentages of the basic and non-basic nitrogen compounds comprising the total nitrogen content of a shale oil varies depending upon the particular shale oil but typically are in the ranges of 60% to 70% basic nitrogen-containing compounds and 30% to 40% non-basic nitrogen-containing compounds.

The nitrogen content of shale oil is generally up to about 2% by weight. For example, the average nitrogen content of shale oil recovered by in situ retorting of oil shale from the Piceance Creek Basin of Western Colorado is on the order of about 1.4% by weight. This is very high when compared with the nitrogen content of crude petroleum which is typically no more than about 0.3% by weight.

The presence of nitrogen in shale oil presents many problems in that the nitrogen can interfere with refining, transportation, and use of shale oil. Deleterious effects brought about by the presence of nitrogen in shale oil are decreased catalyst life in hydrogenation, reforming, hydrocracking and catalytic cracking reactions, decreased chemical stability of products, and decreased color stability of products.

Another problem with the presence of nitrogen in shale oil is that it is undesirable to transport nitrogen-containing shale oil through pipelines which are also used for transporting petroleum products because of possible contamination of such products with residual nitrogen-containing shale oil in the pipeline. Generally such petroleum products contain a very low nitrogen content. The relatively high nitrogen content in the shale oil can pollute the pipelines making them undesirable and uneconomical for transporting such low nitrogen-containing petroleum products. In addition, a high nitrogen content in shale oil can cause clogging of pipelines due to self-polymerization brough about by the reactivity of the nitrogen-containing compounds. Due to the basicity of the nitrogen-containing compounds in shale oil, some corrosion can occur, thus damaging a pipeline used to transport shale oil.

Product stability is a problem that is common to many products derived from shale oil with the major exception of the asphalt cut and those products that have undergone extensive hydrotreating. Such instability, including photosensitivity, is believed to result primarily from the presence of nitrogen-containing compounds.

It is, therefore, desirable to reduce the nitrogen content of shale oil to increase the utility, transportability, and stability of the shale oil and the products derived from such shale oil.

Conventionally, nitrogen removal in shale oil has been achieved by hydrogenation processes, extraction processes or a combination of both processes.

In extraction processes, the shale oil is contacted with an extraction agent, usually an immiscible solvent capable of selectively extracting nitrogen-containing compounds. As illustrative, U.S. Pat. No. 4,272,361 to Compton discloses a method for reducing the nitrogen content of shale oil by contact with an aqueous solution comprising an active solvent for nitrogen-containing compounds and sufficient water to provide phase separation. The active solvent is selected from the group consisting of organic acids and substituted organic acids.

Extraction processes are useful in extracting a portion of the nitrogen-containing compounds from shale oil. However, the selectivity of these processes is insufficient to reduce the nitrogen content to a level wherein the shale oil can undergo further refinement, such a catalytic cracking, without extracting a significantly large portion of the non-nitrogen-containing compounds. This leads to a low oil recovery.

In hydrogenation processes, also referred to as hydrotreating, the shale oil is heated in the presence of hydrogen gas under extreme pressure. This results in a very large consumption of hydrogen gas. For example, reduction of the nitrogen content of shale oil to about 500 ppm may require a partial hydrogen pressure of about 2,000 psi or more at a temperature of from about 760° F. to 790° F. and from about 0.5 to about 1.0 liquid hourly space velocity (LHSV). Hydrogen consumption of about 2,500 standard cubic feet per barrel results.

Combination processes including chemical extraction and hydrogenation processes have also been disclosed. The object of these processes is to provide a method for reducing the hydrogen consumption that results from upgrading high nitrogen shale oil feed stocks.

For example, in U.S. Pat. No. 4,159,940 to Smith, there is disclosed a process wherein a high nitrogen syncrude feed is contacted with at least one acid selected from the group consisting of sulfuric, phosphoric and hydrochloric acids to produce a first phase low in nitrogen and a second phase high in nitrogen. The second phase then undergoes severe hydrotreating and the first phase undergoes mild hydrotreating.

U.S. Pat. No. 4,261,813 also to Smith improves the above process by removing the acid solvent from the high nitrogen phase to produce a high nitrogen extract oil which is passed to a hydrogen-producing plant to supply hydrogen for hydrotreating. The low nitrogen first phase is hydrotreated at mild conditions.

U.S. Pat. No. 4,287,051 to Curtin discloses a process wherein a high nitrogen feed oil is separated into a first portion and a remaining highly viscous portion. Nitrogen compounds are extracted from the first portion with an acid solvent to produce a low nitrogen raffinate and a high nitrogen extract. The acid solvent is then recovered from the extract to produce a high nitrogen extract oil. The highly viscous portion and the high nitrogen extract oil are partially oxidized to product hydrogen which is used to mildly hydrotreat the low nitrogen raffinate.

These combination processes demonstrate an attempt to reduce the hydrogen consumption of hydrotreating shale oil by incorporating a liquid extraction step. However, to maximize oil recovery, both the low nitrogen phase and the high nitrogen phase resulting from the extraction must be hydrotreated. This results in separate hydrotreating which is expensive. The alternative is to not hydrotreat the second nitrogen phase. However, this reduces oil recovery.

SUMMARY OF THE INVENTION

There is provided a process for reducing the nitrogen content of shale oil. The process comprises first introducing a shale oil feed having compounds of varying molecular weights to a distillation zone wherein the shale oil is heated sufficiently to vaporize lighter shale oil compounds having lower boiling points. The vaporized shale oil is condensed and forms a distillate which contains lighter shale oil compounds, including ligher nitrogen-containing compounds. The distillate is collected in a select number of fractions. The unvaporized portion of the shale oil forms a residue or bottoms which contains heavier shale oil compounds, including heavier nitrogen-containing compounds having boiling points higher than the distillation temperature.

Each fraction of distillate is passed to a separate extraction zone wherein each is contacted with an extraction agent capable of selectively extracting lighter nitrogen-containing compounds from that fraction to form a select number of nitrogen-lean raffinates and a select number of nitrogen-rich extracts. The extraction agents are preferably aqueous solutions containing an organic acid solvent.

Each raffinate is then separated from the formed extract. The nitrogen content of at least one such raffinate is sufficiently low that it can undergo further processing by a conventional crude petroleum refining process without the need for further nitrogen reduction.

The nitrogen-rich extracts are treated to recover the extraction agent. When an organic acid solvent is used as the extraction agent, the nitrogen-rich extracts are heated to vaporize at least a portion of the solvent which is then condensed. The unvaporized portion of the extract forms a nitrogen-rich extract oil.

The bottoms of the distillation is passed to another extraction zone and contacted with a separate extraction agent capable of selectively extracting nitrogen-containing compounds from the bottoms to thereby form a nitrogen-lean raffinate having a reduced nitrogen content and a nitrogen-enriched extract. The extraction agent for the bottoms is also preferably an aqueous solution containing an organic acid solvent. The nitrogen-lean raffinate is then separated from the formed nitrogen-enriched extract.

The nitrogen-lean raffinate formed from the bottoms plus any raffinate produced from a distillate fraction having a nitrogen content too high to be passed to a conventional crude petroleum refining process can be passed to hydrotreating zones and mildly hydrotreated to further reduce the nitrogen level. The hydrotreated raffinates can then be combined with the distillate raffinates not requiring hydrotreating.

The nitrogen-enriched extract formed from the bottoms is also treated to recover the extraction agent and to thereby form a nitrogen-rich extract oil.

BRIEF DESCRIPTION OF THE DRAWING

These and other features and advantages of the present invention will be better understood by reference to the following detailed description when considered in conjunction with the accompanying drawing which is a flow diagram of a preferred embodiment of the invention.

DETAILED DESCRIPTION

In accordance with the present invention, crude or processed shale oil is upgraded by first distilling the shale oil to form a distillate, which is collected in a select number of fractions. Each fraction and the residue or bottoms of the distillation is then introduced to separate extraction zones wherein nitrogen-containing compounds in the fraction or residue are chemically extracted by an extraction agent for selectively extracting nitrogen-containing compounds from that fraction or residue. Such a chemical extraction yields a high-nitrogen extract and a low-nitrogen raffinate. In a preferred embodiment of the invention, the low-nitrogen raffinate of at least one fraction, containing lighter nitrogen-containing compounds, has a nitrogen content sufficiently low to be able to undergo conventional crude petroleum refining without the need for any additional nitrogen removal processing steps. Each low nitrogen raffinate from such a chemical extraction that has a nitrogen content too high to undergo conventional crude petroleum refining can be mildly hydrotreated to further reduce its nitrogen content.

As used herein, the term "crude shale oil" refers to the liquid product that is recovered from retorting oil shale. The term encompasses liquid products formed during surface retorting processes or in situ oil shale retorting processes, which products have not undergone any further processing other than water removal or emulsion breaking. The term "processed shale oil" is used herein to indicate crude shall oil which has undergone some processing, such as, for example, sulfur removal, fractionation, and the like.

Nitrogen-containing compounds are present in most crude or processed shale oils in a broad distribution according to their boiling points. It has been found that when certain crude or processed shale oil feeds are distilled into a select number of generally equal distillate fractions, the nitrogen content of each fraction is roughly about the same. For other shale oil feeds, the nitrogen content of fractions containing heavier shale oil compounds tends to be greater than fractions containing lighter shale oil compounds.

It has also been found that in a chemical extraction process, lighter nitrogen-containing compounds, having lower boiling points, are selectively extracted to a greater extent than heavier nitrogen-containing compounds which have higher boiling points. The nitrogen content of lower boiling point shale oil fractions, containing lighter shale oil compounds, including lighter nitrogen-containing compounds, is reduced by such a chemical extraction to a greater extent than the nitrogen content of higher boiling point shale oil fractions.

In a preferred embodiment of the invention as shown in the drawing, nitrogen-containing compounds are removed from shale oil by first introducing by line 11 crude or processed shale oil to a distillation zone 12 wherein the shale oil is heated sufficiently to vaporize a portion of the shale oil. The vaporized portion generally contains lighter shale oil compounds which have lower boiling points than the non-vaporized portion. The vaporized portion is condensed in a condensation zone 13 and forms a distillate 14.

Heavier nitrogen-containing compounds in the crude or processed shale oil, including heavier non-nitrogen-containing compounds, generally require a higher distillation temperature to be vaporized than lighter shale oil compounds. At the temperature of the distillation, heavier shale oil compounds which do not vaporize form a residue or bottoms 16.

The preferred temperature of the distillation is selected to produce a distillate which is capable of undergoing a chemical extraction to thereby generate a nitrogenlean raffinate which has a nitrogen content sufficiently low that it can undergo further processing in a conventional crude petroleum process.

Generally the nitrogen content of crude petroleum does not exceed about 3,000 ppm and for many crude petroleum feeds, does not exceed about 2,000 ppm. The preferred temperature of the distillation, then, is selected to produce a distillate that is capable of having its nitrogen content reduced by a chemical extraction to no more than about 3,000 ppm, and more preferably to no more than about 2,000 ppm.

The temperature selected will depend on the nitrogen content of the shale oil feed, the relative amounts of lighter and heavier nitrogen-containing compounds and the selectivity of the extraction agent.

In a particularly preferred embodiment of the invention, the distillation temperature is selected to produce a distillate capable of undergoing a chemical extraction to reduce the nitrogen content to no more than about 3,000 ppm, and preferably to no more than about 2,000 ppm, without a significant loss of non-nitrogen-containing compounds resulting from the extraction of non-nitrogen-containing compounds.

As used herein, "a significant loss of non-nitrogen-containing compounds" refers to the extraction of more than 10% of the non-nitrogen-containing compounds present in the distillate.

It is presently preferred that the distillation operation comprises an atmospheric distillation as this is believed to be the most economical method. However, vacuum distillation, vacuum flashing, atmospheric flashing processes and the like are also applicable to this process.

After the distillate is collected, it is passed, either as a continuous stream or in separate portions, to a first extraction zone containing a first extraction agent capable of selectively extracting nitrogen-containing compounds from the shale oil distillate. The presently preferred first extraction agent comprises a first substantially immiscible solvent containing water and an organic acid which has a high selectivity for extracting and retaining nitrogen-containing compounds.

As used herein, "substantially immiscible" solvent refers to solvents that are totally immiscible in shale oil and, additionally, to solvents that are partially miscible in shale oil in an amount less than about 5% by weight of the shale oil.

It is presently preferred that the first extraction agent comprise a first substantially immiscible solvent containing an organic acid because solvents comprising inorganic acids or salts have a greater tendency to form emulsions with shale oil than organic acid and therefore require longer separation times. The presently preferred organic acids are acetic acid and formic acid.

The amount of water mixed with the organic acid in the first immiscible solvent is in the range of from about 5% to about 50% and preferably from about 10% to about 30%, depending on the acid selected. The amount of water is sufficient to make the acid substantially immiscible with shale oil and is chosen to achieve the desired selectivity toward extraction and retention of nitrogen-containing compounds from the shale oil distillate. A small amount of water, i.e., a high concentration of the organic acid, results in a high capacity for extracting and retaining nitrogen-containing compounds, but also results in a loss of selectivity towards extracting only nitrogen-containing compounds and, therefore, increases the extraction of desirable non-nitrogen-containing compounds. A large amount of water, i.e., a low organic acid concentration, results in high selectivity for extracting only nitrogen-containing compounds, but also results in a loss of capacity for extracting and retaining nitrogen-containing compounds, leading to an insufficient reduction of the nitrogen content of the shale oil.

The concentration of the organic acid in the first immiscible solvent is preferably maintained at a level which results in a first raffinate having a nitrogen content sufficiently low to enable the raffinate to be passed to conventional crude petroleum refining without the need for additional nitrogen removing processing steps. Specifically, the raffinate does not require hydrotreating to further reduce the nitrogen content prior to conventional crude petroleum refining. The amount of nitrogen in the raffinate is sufficiently low to not deleteriously effect the hydrogenation, reforming, hydrocracking and catlytic cracking reactions of conventional crude petroleum refining.

The concentration of the organic acid in the first immiscible solvent is therefore adjusted to produce a raffinate which contains less than about 3,000 ppm of elemental nitrogen and preferably less than about 2,000 ppm nitrogen. The concentration of the organic acid is preferably maintained at the lowest concentration that results in such a raffinate as lower ogranic acid concentrations tends to minimize the extraction of non-nitrogen-containing compounds.

The concentration of the organic acid is dependent on the nitrogen content of the distillate introduced into the first extraction zone and on the selectivity of the organic acid for extracting nitrogen-containing compounds from the distillate. The concentration of organic acid that is used, therefore, preferably produces the maximum amount of raffinate having such a nitrogen content, i.e., generates the maximum yield.

The volume ratio of the first immiscible aqueous solvent to shale oil distillate that is required for extracting nitrogen-containing compounds from the shale oil distillate depends upon the nitrogen content of the shale oil distillate and the solubility of such nitrogen-containing compounds in the first immiscible solvent. The ratio of first immiscible solvent to shale oil distillate can be from about 5 parts solvent for each part shale oil to about 1 part solvent per 10 parts shale oil. The preferred ratio of first substantially immiscible solvent to shale oil distillate maximizes nitrogen removal without a significant loss of non-nitrogen-containing compounds.

It is presently preferred that the distillate extraction be conducted at ambient temperature. However, elevated temperatures can be used.

The distillate extraction can be conducted as a batch extraction, as shown in the drawing. In such a batch extraction, the first substantially immiscible solvent is introduced by a line 19 to the first extraction zone 18 which comprises a mixer settler 20. The shale oil distillate 14 is introduced to the mixer settler 20 by a line 17. The distillate and the first substantially immiscible solvent are mixed by a mixer 22 to achieve equilibrium rapidly. Average residence time in the mixing stage is generally from about 2 to about 3 minutes. Following mixing, about 15 to 60 minutes is generally required for settling of the lower solvent phase 23 from the upper shale oil phase 24. The upper shale oil phase 24 forms a first raffinate and is then separated from the lower solvent phase which forms a first nitrogen-rich extract by conventional liquid-liquid separation techniques, e.g., decanting the upper phase, withdrawing the lower phase or, as shown, removing by line 25.

The first raffinate may be treated to recover any extraction agent that is present in the raffinate. When an organic acid solvent is used as the extraction agent, a small amount of the extraction agent generally dissolves into the shale oil and remains in the raffinate after it is separated from the extract. Such an organic acid solvent can be recovered by distilling the raffinate. The solvent is recovered as distillate and can be recycled.

Successive extractions can be used to further reduce the nitrogen content of the raffinate from the shale oil distillate.

Alternatively, nitrogen-containing compounds can be removed from the shale oil distillate in the first extraction zone by a continuous extraction process. In such a process, the shale oil distillate is introduced as a stream to a first extraction zone which comprises a conventional countercurrent contactor. Typically, the extraction zone comprises a downwardly-flowing first substantially immiscible solvent stream and an upwardly-flowing shale oil distillate stream. As the shale oil distillate moves upward, contact is made with the solvent stream and nitrogen-containing compounds are removed. A first shale oil raffinate having a reduced nitrogen content is recovered at the top of the first extraction zone. A first nitrogen-rich extract is recovered at the bottom of the first extraction zone.

The products of the distillate extraction comprise a first shale oil raffinate having a reduced nitrogen content and a first nitrogen-rich extract.

The unvaporized portion of the shale oil feed remaining in the distillation zone forms a residue or bottoms 16 which generally contains heavier shale oil compounds. The bottoms is passed by a line 26 from the distillation zone 12 to a second extraction zone 27 containing a second extraction agent which is capable of extracting nitrogen-containing compounds from the bottoms.

The presently preferred second extraction agents comprise a second substantially immiscible aqueous solvent containing at least one organic acid component. Particularly preferred organic acid components are acetic acid and formic acid.

The amount of water mixed with the organic acid in the second immiscible solvent is also in the range of from about 5% to about 50% and preferably from about 10% to about 30%, depending on the acid selected. The amount of water is sufficient to make the acid substantially immiscible with shale oil and is chosen to achieve the desired selectivity toward extraction and retention of nitrogen-containing compounds from the shale oil bottoms.

The concentration of the organic acid in the second immiscible solvent is preferably maintained at a level which provides the optimum combination of nitrogen removal and oil recovery, i.e., recovery of non-nitrogen-containing compounds.

The concentration of organic acid is dependent on the nitrogen content of the bottoms introduced into the second extraction zone and on the selectivity of the organic acid component of the second immiscible solvent for extracting nitrogen-containing compounds from the bottoms.

The volume ratio of the second immiscible aqueous solvent to shale oil bottoms that is required for extracting nitrogen-containing compounds from the shale oil bottoms depends upon the nitrogen content of the shale oil bottoms and the solubility of such nitrogen-containing compounds in the second immiscible solvent. The ratio of second immiscible solvent to shale oil distillate can be from about 5 parts solvent for each part shale oil to about 1 part solvent per 10 parts shale oil. The preferred ratio of second substantially immiscible solvent to shale oil bottoms provides the optimum combination of nitrogen removal and recovery of non-nitrogen-containing compounds.

It is presently preferred that the bottoms extraction be conducted at ambient temperature. However, elevated temperatures can be used and are particularly useful for a residue or bottoms that tends to be highly viscous.

Elevated temperatures significantly reduce the viscosity of shale oils. A less viscous shale oil bottoms generally requires less contact time between the bottoms and the second substantially immiscible solvent for nitrogen-containing compounds to be contacted and be extracted by the second substantially immiscible solvent. A less viscous shale oil bottoms also generally requires less settling time than a more viscous shale oil bottoms. While requiring energy to heat the mixture and while increasing the vapor pressure of the second substantially acid solvent, a reduction in the viscosity of the shale oil bottoms due to an elevated temperature can thus be advantageous. The maximum temperature of the extraction mixture is that temperature which causes an undesirable loss of the organic component of the second substantially immiscible solvent due to an increase in the vapor pressure of the second substantially immiscible solvent. The maximum temperature, therefore, cannot exceed the boiling point of the second substantially immiscible solvent.

The bottoms extraction can also be conducted as a batch extraction, as shown in the drawing or in a continuous extraction process as previously described. In such a batch extraction, the second substantially immiscible solvent is introduced by a line 31 to the second extraction zone 27 which comprises a mixer settler 37. The shale oil distillate is introduced to the mixer settler 37 by a line 26. The distillate and the first substantially immiscible solvent are mixed by a mixer 33 to achieve equilibrium rapidly. Average residence time in the mixing stage is from about 2 to about 3 minutes. Following mixing, about 15 to 60 minutes is generally required for settling of the lower solvent phase 34 from the upper shale oil phase 35. The upper shale oil phase 35 forms a second raffinate and is separated from the lower solvent phase 34 which forms a second nitrogen-rich extract by conventional liquid-liquid separation techniques, e.g., decanting the upper phase or withdrawing the lower phase.

The second raffinate may be treated to recover any extraction agent that is present in the second raffinate. When an organic acid solvent is used as the extraction agent, a small amount of the extraction agent generally dissolves into the shale oil and remains in the raffinate after it is separated from the extract. Such an organic acid solvent can be recovered by distilling the raffinate. The solvent is recovered as distillate and can be recycled.

Successive extractions can be used to further reduce the nitrogen content of the second raffinate produced from the shale oil bottoms.

The products of the bottoms extraction comprise a second shale oil raffinate having a reduced nitrogen content and a second nitrogen-rich extract.

The first high-nitrogen extract from the first extraction zone includes nitrogen-containing compounds and the first substantially immiscible solvent. At least a portion of the organic acid component of the first substantially immiscible solvent is recovered by passing the first high nitrogen extract to a first solvent recovery zone 37 by a line 38. The first high-nitrogen extract is heated sufficiently to vaporize at least a portion of the organic component which is then condensed and recovered as a first solvent condensate 39 in a first condensation zone 41. Nitrogen-containing compounds and other extracted shale oil compounds remain as a first unvaporized residue 42 in the first solvent recovery zone 37. The first unvaporized residue 42 forms a first high-nitrogen extract oil. The concentration of that portion of the first substantially immiscible solvent that is recovered is then adjusted and can be recycled to the first extraction zone for use in a subsequent extraction to reduce the nitrogen content of additional shale oil distillate.

Likewise, in a similar process, at least a portion of the organic acid component of the second substantially immiscible solvent is recovered by passing the second high-nitrogen extract to a second solvent recovery zone 44 by a line 46. The second high-nitrogen extract is heated sufficiently to vaporize at least a portion of the organic component which is then condensed and recovered as the second solvent condensate 47 in a second condensation zone 48. Nitrogen-containing compounds and other extracted shale oil compounds remain as a second unvaporized residue 49 in the second solvent recovery zone. The second unvaporized residue 49 forms a second high-nitrogen extract oil. The concentration of that portion of the second substantially immiscible solvent that is recovered is then adjusted and can be recycled to the second extraction zone for use in a subsequent extraction to reduce the nitrogen content of additional shale oil bottoms.

Other methods for recovering a portion of either the first or second substantially immiscible solvent may be used. For example, some of the nitrogen-containing compounds that are basic can be precipitated from the solvent by adding a stronger base. Alternatively, the nitrogen-containing compounds can be extracted from the solvent in another extraction process.

The first high-nitrogen extract oil and the second high-nitrogen extract oil are preferably combined for further processing.

In a particularly preferred embodiment of the invention the organic component of the second substantially immiscible solvent is the same as the organic component of the first substantially immiscible solvent. In such an embodiment of the invention, the first high-nitrogen extract is combined with the second high-nitrogen extract. The combined extracts are then passed to a solvent recovery zone wherein at least a portion of the common organic acid component is recovered. The concentration of the recovered solvent component is then adjusted and the resulting solvent is recycled to either the first or second extraction zone or both. The unvaporized portion of the combined extracts forms a combined high-nitrogen extract oil.

The combined first and second high-nitrogen extract oil can be treated to reduce its nitrogen content. Alternatively, it can be used as a feedstock for hydrogen gas generation. Or, because of its high nitrogen content, the combined high-nitrogen extract oil can be used in the production of nitrogen compounds and various chemical intermediates containing nitrogen. Such a high-nitrogen extract oil can also be used as an asphalt, which provides good adhesive properties because of its nitrogen content and ability to crosslink through nitrogen.

The second raffinate, although having a lower nitrogen content as a result of the second chemical extraction generally has a nitrogen content too high to be passed directly to conventional crude petroleum refining for further processing.

The second raffinate is therefore introduced by line 52 to a guard bed 53 in which arsenic-containing compounds are removed in the presence of hydrogen and then by line 54 to a hydrotreating zone 56 in which the second raffinate undergoes a mild hydrotreatment to further reduce its nitrogen content.

The guard bed 53 prevents fouling of the hydrogenation catalyst in the hydrotreating zone 56 by arsenic-containing compounds present in the second raffinate by removing at least a portion of those compounds before the shale oil is introduced to the hydrotreating zone 56. In the guard bed 53, hydrogen gas and second raffinate are mixed and passed over a catalyst bed at an appropriate temperature and pressure. Arsenic-containing compounds are removed from the second raffinate by deposition on the catalyst. The catalysts that are used in such a guard bed are inexpensive and commercially available and are generally discarded after use.

Nitrogen-containing compounds tend to be more difficult to remove from shale oil than arsenic-containing compounds. The conditions maintained in the guard bed, including temperature, pressure and the partial pressure of hydrogen gas, are generally insufficient to remove nitrogen-containing compounds from the second raffinate. To remove the nitrogen-containing compounds, the arsenic-lean second raffinate is passed to a hydrotreating zone 56.

In the hydrotreating zone 56, the second raffinate is mixed with hydrogen gas at an elevated temperature and pressure and passed over a hydrogenation catalyst.

The temperature, pressure, and flow that are required depend on the remaining nitrogen content of the second raffinate but are typically in the ranges 800 to 1500 psig., 0.5 to 1.0 LHSV, and 650° to 700° F. Applicable catalysts include nickel-molybdenum catalysts. Under such conditions, nitrogen-containing compounds react to form gaseous ammonia which is then separated from the second raffinate. In addition, sulfur-containing compounds present in the second raffinate react to form hydrogen sulfide gas which is likewise removed, thereby reducing the sulfur content of the second raffinate.

Conditions in the hydrotreating zone are maintained at levels in which sufficient nitrogen-containing compounds in the second raffinate are converted to ammonia to reduce the nitrogen content of the second raffinate to about the nitrogen content of the first raffinate, i.e., to no more than about 3,000 ppm and preferably to no more than about 2,000 ppm. The second raffinate is then separated from the gas phase. The second raffinate, thus hydrotreated, is in condition to undergo further processing by a conventional crude petroleum refining process and can be combined with the first raffinate.

The preceding description has been presented with reference to a presently preferred embodiment in which the distillate is collected in a single fraction. The distillation can also be carried out to yield a select number of consecutively collected separate distillate fractions rather than a single distillate fraction. In such a process, the first distillate fraction collected contains hydrocarbons which are generally lighter and have lower boiling points then hydrocarbons condensed in the second fraction collected, which, in turn, contain hydrocarbons which are generally lighter and have lower boiling points than the next fraction that is collected The last fraction that is collected contains hydrocarbons generally having the heaviest compounds and the highest boiling points of all the fractions collected.

The distillation temperatures of such a fractional distillation are preferably adjusted so that each fraction is capable of undergoing a subsequent chemical extraction which results in a nitrogen-lean raffinate having a nitrogen content of no more than a desired limit, preferably no more than about 3,000 ppm elemental nitrogen, and more preferably no more than about 2,000 ppm.

The quantity of shale collected in each fraction depends on the number of fractions collected, the relative proportions of heavier and lighter nitrogen-containing and non-nitrogen-containing shale oil compounds in the shale oil and the total nitrogen content of the shale oil that is introduced into the distillation zone.

The advantage of generating a select number of distillate fractions is that each fraction comprises hydrocarbon compounds generally within different molecular weight ranges. The extracting agent used in each subsequent chemical extraction can be selected or tailored to optimize its selectivity for the nitrogen-containing compounds within the specific molecular weight range. Such chemical extractions produce a series of nitrogen-lean raffinates which can be readily blended with comparable fractions obtained from the fractionation of crude petroleum in conventional refining processes of the crude petroleum.

This invention has the striking advantage that the nitrogen content of a portion of crude or processed shale oil feed can be reduced sufficiently to enable that portion to undergo further processing by a conventional crude petroleum refining process without the necessity for that portion to undergo a costly hydrogenation. The invention enhances the selectivity and effectiveness of conventional extraction processes. For example, in a conventional extraction process using a substantially immiscible solvent, the solubility of nitrogen-containing compounds in the substantially immiscible solvent tends to be significantly greater than the solubility of non-nitrogen-containing compounds. It has been found that, in general, the solubility of all shale oil compounds in such a solvent tends to decrease as the molecular weight of the shale oil compounds increases. The highest solubility in such a substantially immiscible solvent is, therefore, that of lighter nitrogencontaining compounds. That is, lighter nitrogen-containing compounds tend to be more soluble than all non-nitrogen-containing compounds and more soluble than heavier nitrogen-containing compounds. However, the solubility of nitrogen-containing compounds tends to decrease as the molecular weight of such compounds increases and will approach the solubility level of the lighter non-nitrogen-containing compounds.

When a shale oil feed is contacted with such an immiscible solvent, lighter nitrogen-containing compounds are extracted at the most rapid rate. As the concentration of lighter nitrogen-containing compounds in the shale oil diminishes, the selectivity of the extraction agent, i.e., the substantially immiscible solvent, also diminishes because the solubility of the remaining heavier nitrogen-containing compounds, which approaches that of the lighter non-nitrogen-containing compounds, results in a competing effect with the lighter non-nitrogen-containing compounds. That is, the capacity of the solvent for extracting the remaining heavier nitrogen-containing compounds is reduced, and, in addition, a portion of that capacity is filled by the extraction of competing lighter non-nitrogen-containing compounds.

Dividing the shale oil into fractions according to boiling point, which generally divides the shale oil into fractions according to molecular weight, reduces the competing solubilization of lighter non-nitrogen-containing compounds and heavier nitrogen-containing compounds with the result and effect that heavier nitrogen-containing compounds compete only with heavier non-nitrogen-containing compounds.

The selectivity and efficiency of such a chemical extraction involving only lighter shale oil compounds, separated from heavier shale oil compounds by a distillation, is enhanced because the solubility of lighter nitrogen-containing compounds in the immiscible solvent is significantly greater than that of lighter non-nitrogen-containing compounds and there are no heavier nitrogen-containing compounds required to be extracted.

In addition, the selectivity of such chemical extraction involving only heavier shale oil compounds, which remain as the residue of a shale oil distillation, is enhanced because the solubility of heavier nitrogen-containing-compounds in the immiscible solvent is significantly greater than the heavier non-nitrogen-containing compounds and there are no lighter non-nitrogen-containing compounds with which the heavier nitrogen-containing compounds must compete.

Another advantage of the present invention is that the extraction agent for the lighter nitrogen-containing compounds need not be the same as that for heavier nitrogen-containing compounds. Each can be tailored to optimize the efficiency of each extraction.

What is claimed is:

1. A process for reducing the nitrogen content of shale oil containing nitrogen-containing compounds comprising:

distilling shale oil sufficiently to form a distillate and a residue;

contacting the shale oil distillate with a first extraction agent capable of selectively extracting nitrogen-containing compounds from the distillate for a time sufficient to form a first nitrogen-lean raffinate and a first nitrogen-rich extract;

separating the first nitrogen-lean raffinate from the first nitrogen-rich extract;

contacting the shale oil residue with a second extraction agent capable of selectively extracting nitrogen-containing compounds from residue for a time sufficient to form a second nitrogen-lean raffinate and a second nitrogen-rich extract; and separating the second nitrogen-lean raffinate from the second nitrogen-rich extract.

2. A process as claimed in claim 1 wherein the first extraction agent comprises an aqueous solvent immiscible with the distillate comprising at least one organic acid.

3. A process as claimed in claim 1 wherein the second extraction agent comprises an aqueous solvent immiscible with the residue comprising at least one organic acid.

4. A process as claimed in claim 1 wherein the first nitrogen-lean raffinate has a nitrogen content of no more than 3000 ppm.

5. A process as claimed in claim 1 further comprising hydrotreating the second nitrogen-lean shale oil raffinate to remove additional nitrogen-containing compounds.

6. A process for reducing the nitrogen content of a shale oil containing lighter shale oil compounds including lighter nitrogen-containing compounds and heavier shale oil compounds including heavier nitrogen-containing compounds comprising:

separating the shale oil into lighter shale oil compounds and heavier shale oil compounds;

selectively removing at least a portion of the lighter shale oil compounds containing nitrogen from the separated lighter shale oil compounds to form a first nitrogen-lean raffinate; and selectively removing at least a portion of the heavier shale oil compounds containing nitrogen from the separated heavier shale oil compounds to form a second nitrogen-lean raffinate.

7. A process as claimed in claim 6 wherein the lighter shale oil compounds are separated from the heavier shale oil compounds by heating the shale oil sufficiently to vaporize lighter shale oil compounds and condensing the vaporized lighter shale oil compounds to thereby form a lighter shale oil distillate.

8. A process as claimed in claim 6 wherein at least a portion of the lighter shale oil compounds containing nitrogen are removed by contacting the separated lighter shale oil compounds with a first extraction agent for selectively extracting lighter nitrogen-containing compounds from said lighter shale oil.

9. A process as claimed in claim 6 wherein at least a portion of the heavier shale oil compounds containing nitrogen are removed by contacting the separated heavier shale oil compounds with a second extraction agent for selectively extracting nitrogen-containing compounds from shale oil.

10. A process as claimed in claim 6 wherein the nitrogen content of the first nitrogen-lean raffinate is no more than about 3,000 ppm.

11. A process as claimed in claim 6 wherein the nitrogen content of the first nitrogen-lean raffinate is no more than about 2,000 ppm.

12. A process for reducing the nitrogen content of shale oil containing nitrogen-containing compounds comprising:

distilling shale oil to form a distillate, which is collected in a number of fractions, and a residue;

separately contacting each collected fraction of the distillate and the residue with a separate extraction agent capable of extracting nitrogen-containing compounds from the collected fractions and residue, for a time sufficient to form, for each fraction and for the residue, a nitrogen-lean raffinate and a corresponding nitrogen-rich extract; and separating each nitrogen-lean raffinate from the corresponding nitrogen-rich extract.

13. A process as claimed in claim 12 wherein each extraction agent comprises an aqueous acid solvent containing an organic acid component selected from the group consisting of formic acid, acetic acid and mixtures thereof.

14. A process as claimed in claim 12 wherein the nitrogen content of at least one nitrogen-lean raffinate is no more than about 3,000 ppm.

15. A process as claimed in claim 12 further comprising hydrotreating at least one nitrogen-lean raffinate having a nitrogen content greater than about 3,000 ppm sufficiently to reduce the nitrogen content of that nitrogen-lean raffinate to no more than about 3,000 ppm.

16. A process for reducing the nitrogen content of shale oil containing nitrogen-containing compounds comprising:

introducing shale oil to a distillation zone wherein the shale oil is distilled sufficiently to form a distillate and a bottoms;

contacting, in a first extraction zone, the distillate with a first extraction agent capable of selectively extracting nitrogen-containing compounds from the distillate for a time sufficient to form a first nitrogen-lean raffinate having no more than about 3,000 ppm nitrogen and a first nitrogen-rich extract;

separating the first nitrogen-lean raffinate from the first nitrogen-extract;

contacting, in a second extraction zone, the bottoms with a second extraction agent capable of selectively extracting nitrogen-containing compounds from the bottoms for a time sufficient to form a second nitrogen-lean raffinate and a second nitrogen-rich extract;

separating the second nitrogen-lean raffinate from the second nitrogen-rich extract; and hydrotreating the second nitrogen-lean raffinate to further reduce the nitrogen content of the second nitrogen-lean raffinate.

17. A process as claimed in claim 16 wherein the second nitrogen-lean raffinate is hydrotreated sufficiently to reduce the nitrogen content of the second nitrogen-lean raffinate to no more than about 3,000 ppm.

18. A process as claimed in claim 16 wherein the first extraction agent comprises a solvent immiscible with the distillate and containing an organic acid.

19. A process as claimed in claim 18 wherein the organic acid is selected from the group consisting of formic acid, acetic acid and mixtures thereof.

20. A process as claimed in claim 16 further comprising recovering at least a portion of the first extraction agent from the first nitrogen-rich extract.

21. A process as claimed in claim 16 wherein the second extraction agent comprises a solvent immiscible with the bottoms and containing an organic acid.

22. A process as claimed in claim 21 wherein the organic acid is selected from the group consisting of formic acid, acetic acid and mixtures thereof.

23. A process as claimed in claim 16 futher comprising recovering at least a portion of the second extraction agent from the second nitrogen-rich extract.

24. A process as claimed in claim 16 wherein the nitrogen content of the first nitrogen-lean raffinate is no more than about 2,000 ppm.

25. A process as claimed in claim 16 wherein the second nitrogen-lean raffinate is hydrotreated sufficiently to reduce the nitrogen content of the second nitrogen-lean raffinate to no more than about 2,000 ppm.

26. A process for upgrading shale oil comprising:

distilling a shale oil feed containing nitrogen-containing compounds to form a distillate and a bottoms;

contacting the distillate with a first extraction agent capable of selectively extracting nitrogen-containing compounds from the distillate for a time sufficient to form a first nitrogen-lean raffinate and a first nitrogen-rich extract comprising the first extraction agent and nitrogen-containing compounds;

separating the first nitrogen-lean raffinate from the first nitrogen-rich extract;

removing at least a portion of the first extraction agent from the first nitrogen-rich extract to thereby form a first high-nitrogen extract oil;

contacting the bottoms with a second extraction agent capable of selectively extracting nitrogen-containing compounds from the bottoms for a time sufficient to form a second nitrogen-lean raffinate and a second nitrogen-rich extract comprising the second extraction agent and nitrogen-containing compounds;

separating the second nitrogen-lean raffinate from the second nitrogen-rich extract;

removing at least a portion of the second extraction agent from the second nitrogen-rich extract to thereby form a second high nitrogen extract oil; and hydrotreating the second nitrogen-lean raffinate to further reduce the nitrogen content of the second nitrogen-lean raffinate.

27. A process as claimed in claim 26 wherein the nitrogen content of the first nitrogen-lean raffinate is no more than about 3,000 ppm.

28. A process as claimed in claim 26 wherein the second nitrogen-lean raffinate is hydrotreated sufficiently to reduce its nitrogen content to no more than about 3,000 ppm.

29. A process as claimed in claim 26 wherein the first extraction agent comprises an aqueous solvent containing a first organic acid solvent.

30. A process as claimed in claim 29 wherein at least a portion of the first extraction agent is removed from the first nitrogen-rich extract by heating the first nitrogen-rich extract sufficiently to vaporize at least a portion of the first organic acid solvent.

31. A process as claimed in claim 30 further comprising condensing the vaporized first organic acid solvent.

32. A process as claimed in claim 26 wherein the second extraction agent comprises a second aqueous solvent containing an organic acid solvent.

33. A process as claimed in claim 32 wherein at least a portion of the second extraction agent is removed from the second nitrogen-rich extract by heating the second nitrogen-rich extract sufficiently to vaporize at least a portion of the second organic acid solvent.

34. A process as claimed in claim 33 further comprising condensing the vaporized second organic acid solvent.

35. A process for reducing the nitrogen content of shale oil comprising:

distilling shale oil containing nitrogen-containing compounds to form a shale oil distillate containing nitrogen-containing compounds and a bottoms containing nitrogen-containing compounds;

introducing the shale oil distillate to a first extraction zone containing a first aqueous solvent comprising an organic acid component selected from the group consisting of acetic acid, formic acid and mixtures thereof, and contacting the shale oil distillate with said first aqueous solvent for a time sufficient to form a first nitrogen-lean raffinate and a first nitrogen-rich extract comprising the first aqueous solvent and nitrogen-containing compounds;

separating the first nitrogen-lean raffinate from the first nitrogen-rich extract;

distilling the first nitrogen-rich extract to form a first solvent distillate comprising at least a portion of the organic acid component substantially free of nitrogen-containing compounds and a residue forming a first high-nitrogen extract oil;

introducing the bottoms to a second extraction zone containing a second aqueous solvent comprising an organic acid component selected from the group consisting of acetic acid, formic acid and mixtures thereof, and contacting said bottoms with said second aqueous solvent for a time sufficient to form a second nitrogen-lean raffinate and a second nitrogen-rich extract comprising the second aqueous solvent and nitrogen-containing compounds;

separating the second nitrogen-lean raffinate from the second nitrogen-rich extract;

distilling the second nitrogen-rich extract to form a second solvent distillate comprising at least a portion of the organic acid component of the second aqueous solvent substantially free of nitrogen-containing compounds and a residue forming a second nitrogen extract oil;

hydrotreating the second nitrogen-lean raffinate sufficiently to reduce the nitrogen content of the second nitrogen-lean raffinate to about the nitrogen content of the first nitrogen-lean raffinate; and combining the hydrotreated second nitrogen-lean raffinate with the first nitrogen-lean raffinate.

36. A process as claimed in claim 35 wherein the organic acid component of the second aqueous solvent is the same as the organic acid component of the first aqueous solvent.

37. A process as claimed in claim 36 wherein the first nitrogen-rich extract is combined with the second nitrogen-rich extract and the combined extracts are distilled sufficiently to form a distillate comprising at least a portion of the organic acid component of the first and second aqueous solvents substantially free of nitrogen-containing compounds.

38. A process as claimed in claim 35 further comprising passing the second nitrogen-lean raffinate through a guard bed for removing arsenic-containing compounds prior to hydrotreating the second nitrogen-lean raffinate.

39. A process for upgrading a shale oil feed containing lighter shale oil compounds including lighter shale oil compounds containing nitrogen and heavier shale oil compounds including heavier shale oil compounds containing nitrogen comprising the steps of:

heating the shale oil feed sufficiently to vaporize lighter shale oil compounds;

condensing the vaporized lighter shale oil compounds in a number of consecutively collected fractions;

separately reducing the nitrogen content of each collected fraction by the steps of:

mixing the collected fraction with an extraction agent capable of selectively extracting lighter shale oil compounds containing nitrogen from the collected fraction for a time sufficient to form a nitrogen-rich extract comprising the extraction agent and vaporized shale oil compounds containing nitrogen and a nitrogen-lean raffinate containing vaporized shale oil compounds; and separating the raffinate containing vaporized shale oil compounds from the extract comprising vaporized shale oil compounds containing nitrogen;

reducing the nitrogen content of the unvaporized shale oil by the steps of:

mixing the unvaporized shale oil with an extraction agent capable of selectively extracting heavier shale oil compounds containing nitrogen from the unvaporized shale oil compounds for a time sufficient to form a nitrogen-rich extract comprising the extraction agent and unvaporized shale oil compounds containing nitrogen and a nitrogen-lean raffinate containing unvaporized shale oil compounds; and separating the raffinate containing unvaporized shale oil compounds from the extract comprising unvaporized shale oil compounds containing nitrogen;

hydrotreating the raffinate containing unvaporized shale oil compounds to further reduce its nitrogen content;

combining the raffinates containing vaporized shale oil compounds and the hydrotreated raffinate containing unvaporized shale oil compounds to form a combined nitrogen-lean raffinate.

40. A process as claimed in claim 39 wherein the combined nitrogen-lean raffinate has a nitrogen content of no more than about 3,000 ppm.

41. A process as claimed in claim 39 wherein each extraction agent comprises an aqueous solvent containing at least one organic acid component.

42. A process as claimed in claim 41 wherein all of the extraction agents contain the same organic acid component.

43. A process as claimed in claim 42 further comprising the steps of:

combining all of the extracts comprising vaporized shale oil compounds containing nitrogen and the extract comprising unvaporized shale oil compounds containing nitrogen to form a combined extract;

heating the combined extract sufficiently to vaporize at least a portion of the organic acid component of the extract agent; and condensing the vaporized organic acid component.

* * * * *